US005684279A

United States Patent [19]

Burgett

[11] Patent Number: 5,684,279

[45] Date of Patent: Nov. 4, 1997

[54] COMPUTER KEYBOARD WITH IMPROVED MEMBRANE KEYSWITCH STRUCTURE HAVING DEFLECTION CONCENTRATION FEATURE

[75] Inventor: David A. Burgett, Newman Lake, Wash.

[73] Assignee: Key Tronic Corporation, Spokane, Wash.

[21] Appl. No.: 528,474

[22] Filed: Sep. 12, 1995

[51] Int. Cl.[6] ..... H01H 1/10

[52] U.S. Cl. ..... 200/5 A; 200/512; 200/517

[58] Field of Search ..... 200/5 A, 512–517, 200/5 R

[56] References Cited

U.S. PATENT DOCUMENTS

| | | | |
|---|---|---|---|
| 3,551,616 | 12/1970 | Juliusburger et al. | 200/46 |
| 3,688,065 | 8/1972 | Wolf et al. | 200/159 B |
| 3,693,775 | 9/1972 | Brooks et al. | 197/98 |
| 3,761,944 | 9/1973 | Shimojo | 340/365 A |
| 3,996,430 | 12/1976 | Eberwein et al. | 200/5 A |
| 4,324,472 | 4/1982 | Terada et al. | 354/266 |
| 4,382,165 | 5/1983 | Balash et al. | 200/5 A |
| 4,408,103 | 10/1983 | Smith, III | 200/6 A |
| 4,525,606 | 6/1985 | Sado | 200/5 A |
| 4,720,610 | 1/1988 | MacHarrie | 200/5 A |
| 4,864,084 | 9/1989 | Cardinale | 200/5 A |
| 4,965,421 | 10/1990 | Epperson | 200/514 |
| 5,115,106 | 5/1992 | Weiland et al. | 200/517 |
| 5,298,706 | 3/1994 | English et al. | 200/517 |
| 5,438,177 | 8/1995 | Fagan | 200/517 |
| 5,525,979 | 6/1996 | Engle et al. | 341/32 |

*Primary Examiner*—Michael L. Gellner
*Assistant Examiner*—Michael A. Friedhofer
*Attorney, Agent, or Firm*—Wells, St. John, Roberts, Gregory & Matkin P.S.

[57] ABSTRACT

A computer keyboard 10 has a plurality of keys 24 with each key 24 having a membrane keyswitch 30. Each keyswitch 30 has a lower membrane layer 32 with a printed circuit having switch contacts 42 printed on an upper side thereon within a switch contact area. An upper membrane layer 36 is provided having a printed circuit thereon with switch contacts 46 printed on a lower side thereon within the switch contact area and in actuation alignment with switch contacts 42. Dielectric pads 50 are printed over parts of the switch contact area forming dielectric mounds between switch contact segments. Stress concentration pads 54 are printed on the upper side of the upper layer 36 spaced intermediate the dielectric pads 54 for causing the upper layer 36 to deflect between the dielectric pads 50 to bring portions of the switch contacts 46 into contact with the switch contacts 42. A switch actuator in the form of an annular surface 72 on a rubber dome element 62 uniformly engages the pads 54 as the key is depressed to activate the keyswitch 30.

5 Claims, 10 Drawing Sheets

COMPUTER KEYBOARD WITH IMPROVED MEMBRANE KEYSWITCH STRUCTURE HAVING DEFLECTION CONCENTRATION FEATURE

TECHNICAL FIELD

This invention relates to computer keyboards having membrane keyswitch structures.

BACKGROUND OF THE INVENTION

Most membrane keyswitch structures have a flexible upper layer and a flexible lower layer that are separated by a nonconductive intermediate spacer layer or sheet. Generally the three layers each have a thickness of approximately 0.004 inches. The spacer layer has switch contact apertures at each of the keyswitch locations to permit electrical circuits on the upper layer to be deflected when the keytop is depressed to engage or move into closer proximity with electrical circuits on the lower layer to "activate" a keyswitch. Generally the upper layer is required to deflect approximately 0.004 inches—a distance equivalent to its thickness—during each keyswitch activation. Occasionally after extensive use, the top layer becomes deformed with a permanent sag at the keyswitch location causing the keyswitch to malfunction. However if the thickness of the intermediate spacer sheet is reduce, the keyswitch may be come "supersensitive" to vibration, manufacturing tolerances, geometry, particle contamination and thermal variations.

Efforts have been made to eliminate the intermediate spacer layer or sheet to reduce costs without adversely affecting reliability. For example U.S. Pat. No. 4,382,165 granted to Frederick A. Balash et al on May 3, 1983 illustrates a membrane keyboard in which the circuit layers are separated by dielectric material screened onto one of the circuit layers in a predetermined pattern. The predetermined pattern has openings at the keyswitch contact areas to permit electrical contact between the circuit layers to "activate" the keyswitch. Although such a configuration eliminates the need for the spacer layer, it still permits inadvertent contact between the electrical contacts at the keyswitch contact areas.

One of the advantages and objects of this invention is to prevent the electrical contacts of the membrane keyswitch from inadvertently coming into contact with each other and to prolong the life of the membrane keyswitch.

A further object and advantage of this invention is to provide a very inexpensive technique to be able to vary the force required to activate an membrane keyswitch without having to vary the resilience of the return spring or member.

These and other objectives and advantages of this invention will become apparent to a person of ordinary skill in this art upon carefully reviewing the following description of a preferred embodiment.

BRIEF DESCRIPTION OF THE DRAWINGS

Preferred embodiments of the invention are described below with reference to the accompanying drawings, which are briefly described below.

FIG. 1 is a diagrammatic vertical cross-sectional view of a computer keyboard constructed according to this invention;

FIG. 10 is a vertical cross sectional view taken along line 10—10 in FIG. 8 showing the membrane keyswitch in the deactivated condition;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

A preferred computer keyboard 10 is shown in FIG. 1 having a housing or case 12 at least partially enclosing a plurality of alpha and numerical keys 24. Generally the keys 24 are arranged in rows (not shown). Frequently an alphanumeric computer keyboard used for word processing and business purpose will have in excess of eighty-four keys.

Figure 2:
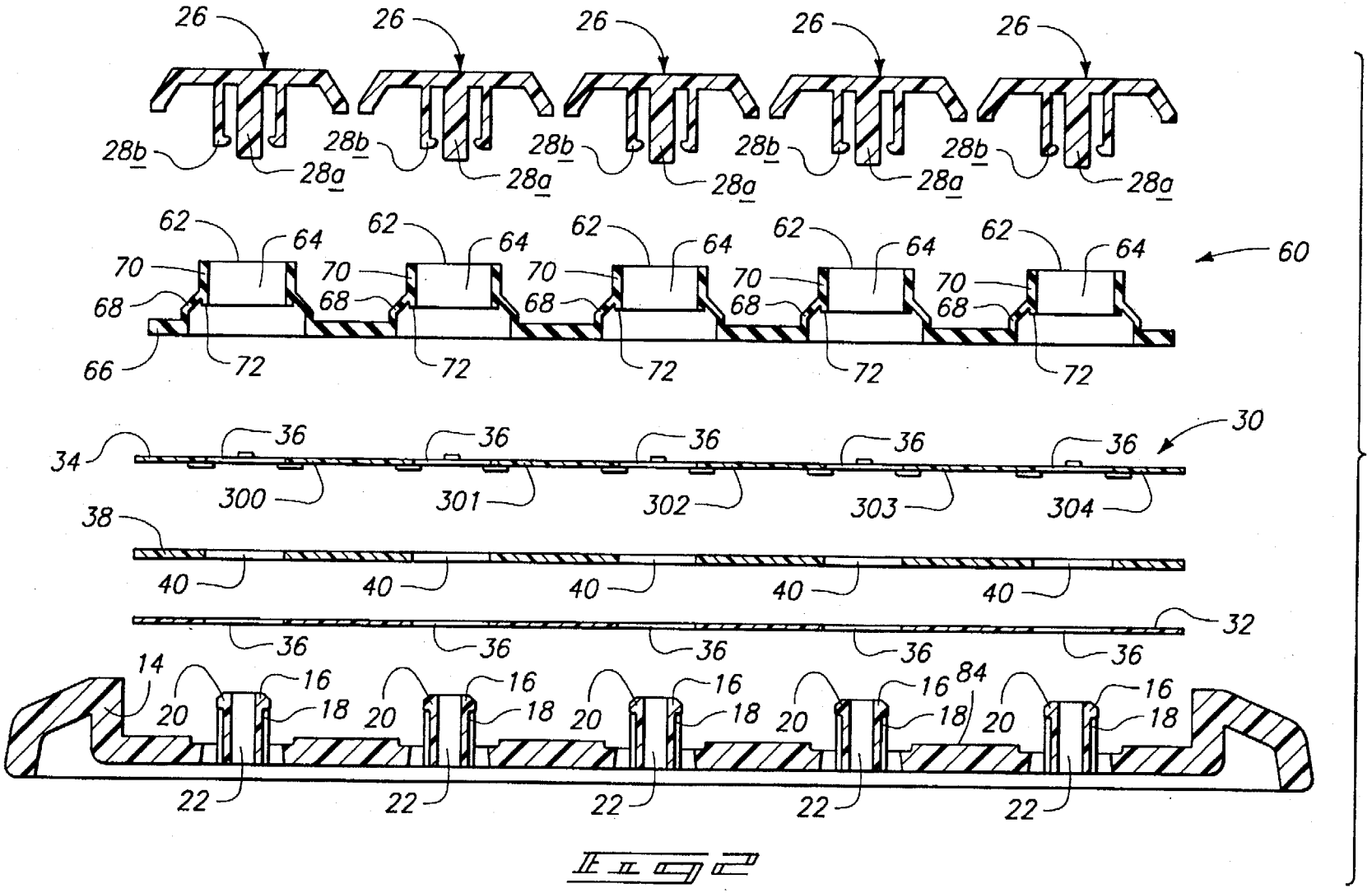
FIG. 2 is an exploded view of the keyboard shown in FIG. 1 illustrating the major components.
Figure 3:
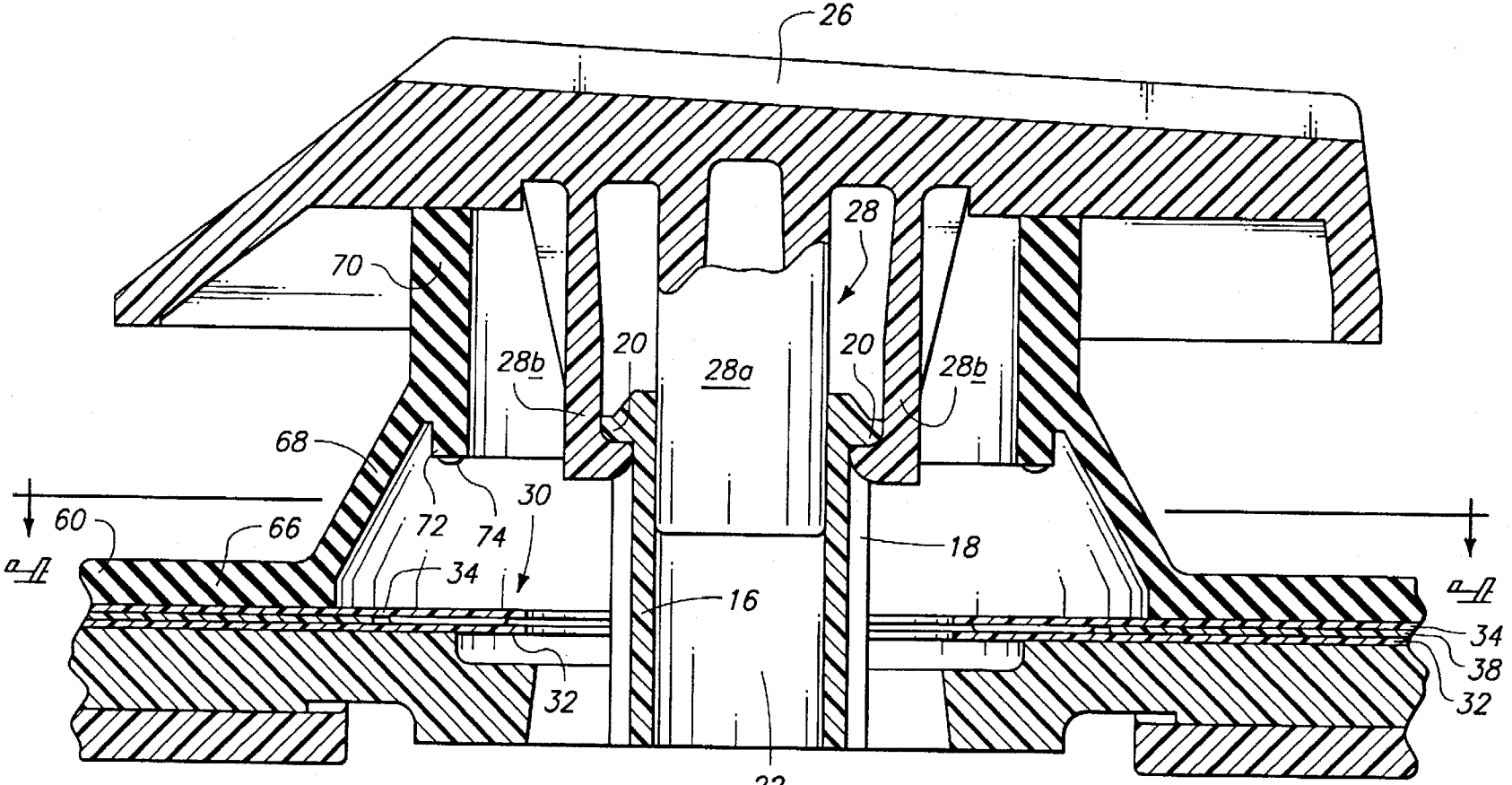
FIG. 3 is a diagrammatic vertical cross-sectional view of single keyboard key illustrated in a rest position with its associated membrane keyswitch in a deactivated condition.
Figure 4:
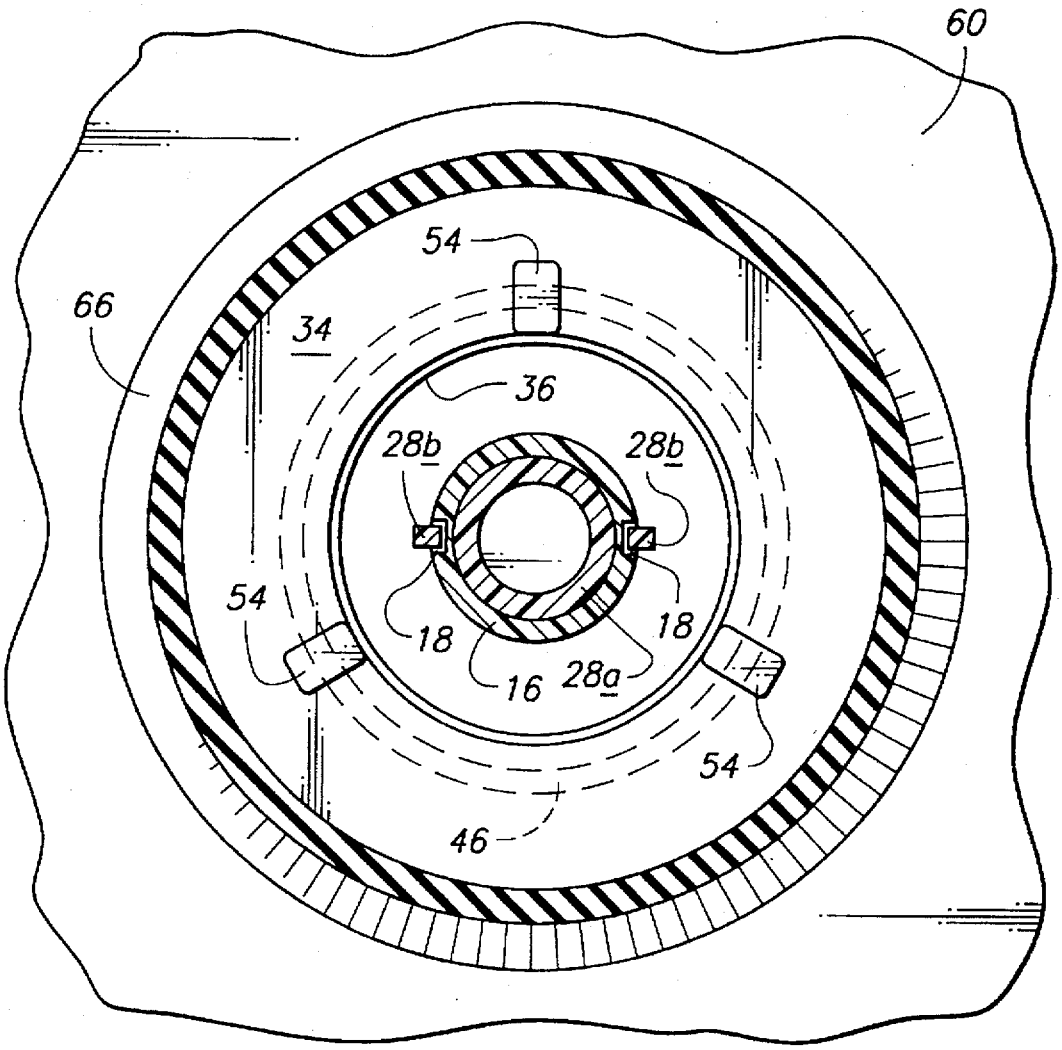
FIG. 4 is a cross-sectional view taken along line 4—4 in FIG. 3.
Figure 5:
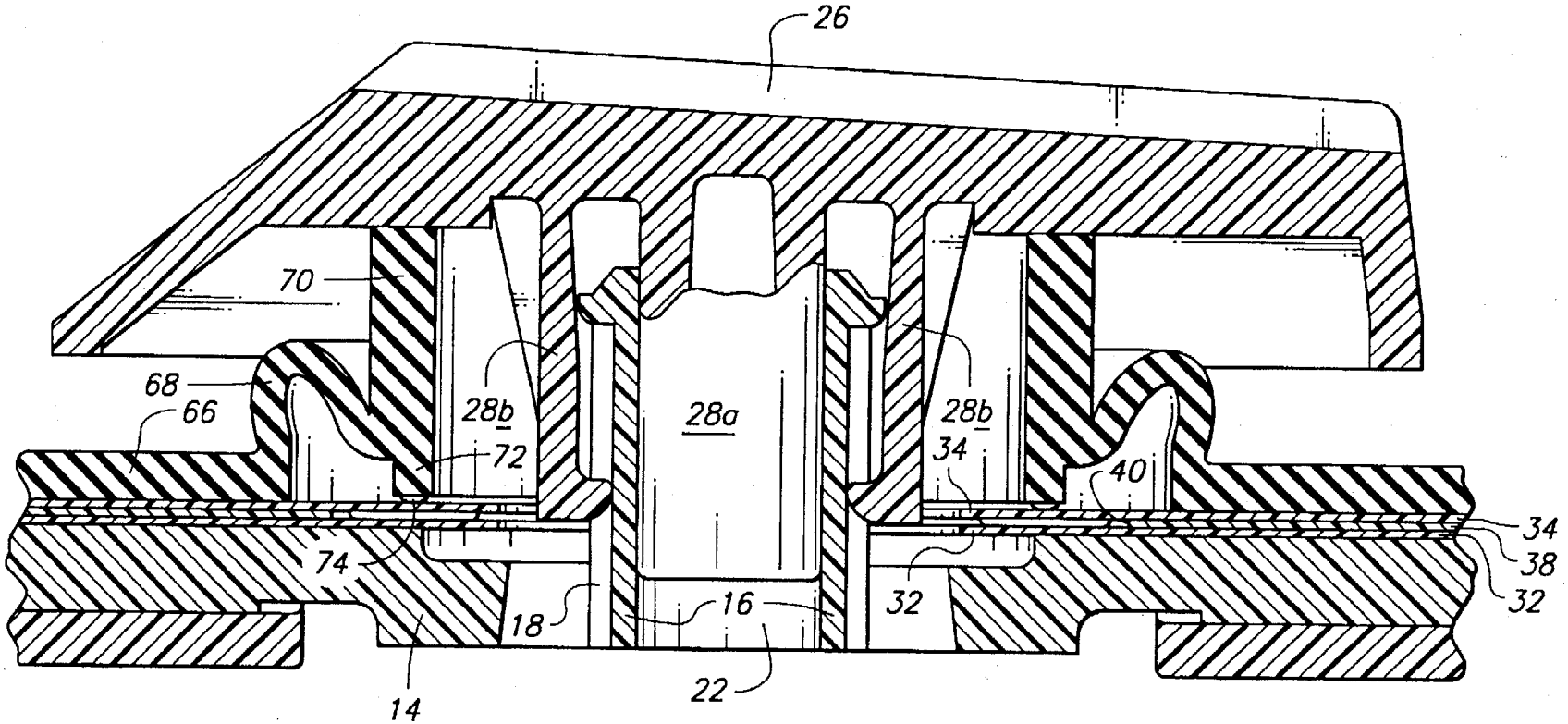
FIG. 5 is a diagrammatic vertical cross-sectional view similar to FIG. 3 except showing the key in a depressed position with it associated membrane keyswitch in an activated condition.
Figure 6:
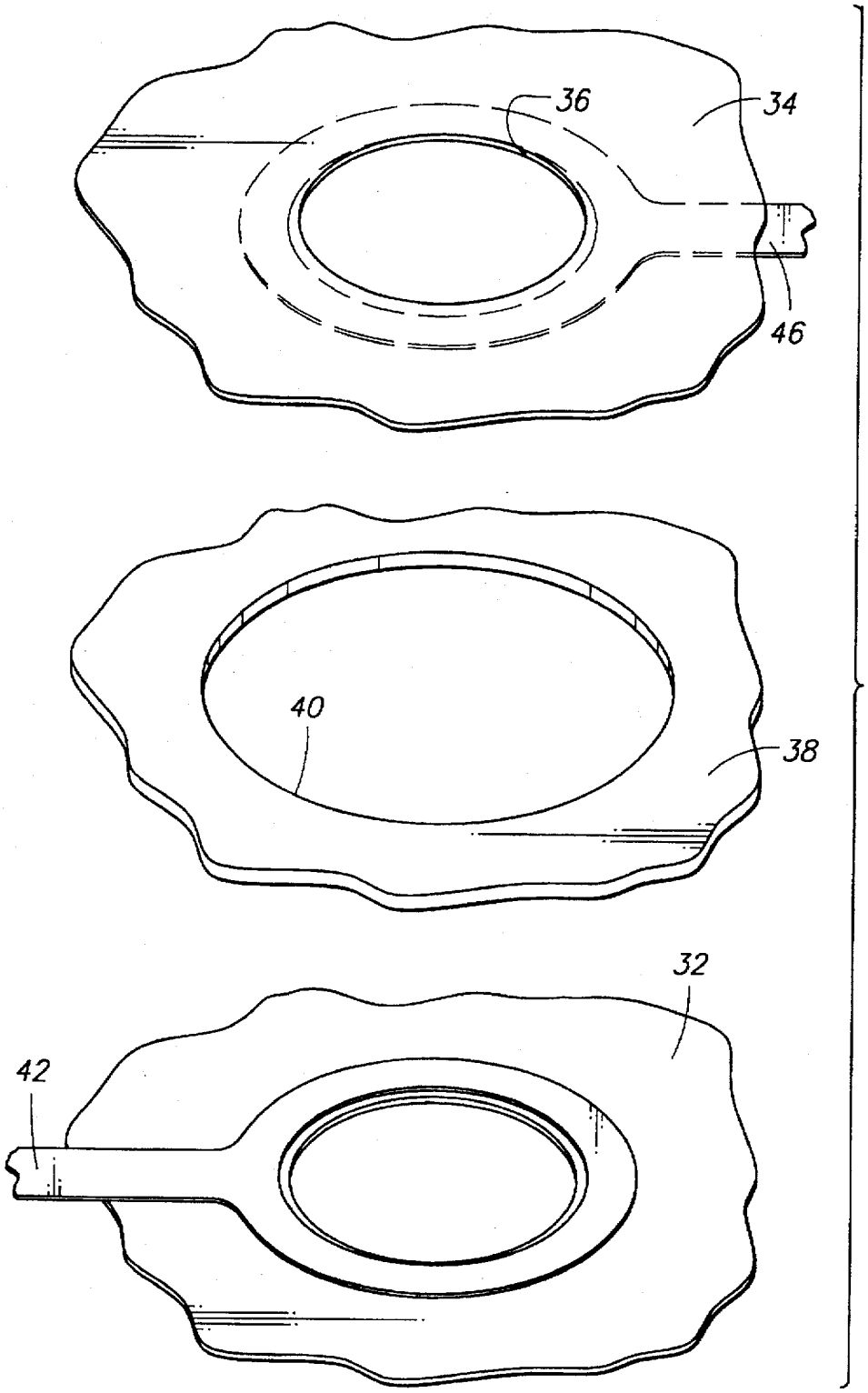
Fig 6 PRIOR ART
FIG. 6 is an exploded view of a prior art membrane keyswitch.

Preferably the keyboard 10 has a unitary key support member 14 frequently referred to as a monoblock. The monoblock 14 has upward extending keystem receiving elements 16 in the form of upstanding cylindrical walls with a central bore having a key axis at each of the key locations. Vertical grooves 18 (FIGS. 2 and 3) are formed in the central bore of the keystem receiving elements 16 terminating in upper shoulders 20 adjacent the upper ends of the upstanding elements 16.

Each of the keys 24 includes a keytop 26 that has a depending keystem 28 that has a central plunger **28*a* that projects into and slides in the central bore of the upstanding monoblock element 16. The keystem 28 also has guiding and mounting fingers 28*b* that extend downward along the outside of the element 16 projecting into the grooves 18 to prevent the keytop 26 from rotating relative to the monoblock element 16. The mounting fingers 28*b* also engage the shoulder 20 when the keytop 26** is the up unclepressed position.

Preferably the monoblock 14 has a hole 22 at each of the key locations to enable the central plunger **28*a*** to project downward into if not through the monoblock on its bottom side when the keystem is depressed. Such a feature reduces the profile of the key while still providing "full travel". Such a configuration is frequently referred to as a "throu-hole membrane keyswitch" design. Such a "throu-hole" feature is illustrated is U.S. Pat. No. 5,115,106 granted to Walter M. Weiland et al on May 19, 1992.

Each key 24 has a membrane keyswitch 30 that activates an electrical circuit when the keytop 26 is depressed to an "activation" position. Each keyswitch 30 includes a lower membrane layer 32 and an upper membrane layer 34 that are supported on the monoblock 14. Generally the lower and upper membrane layers 32,34 are each formed of a dielectric thin flexible sheet material having a thickness of approximately 0.004 inches. The layers 32,34 have apertures 36 formed therein at each of the keyswitches 30. Each of the apertures 36 has a diameter or cross-dimension that is sufficient to enable the layers 32,34 to fit over the upstanding elements 16 of the monoblock 14 with the upstanding stem receiving elements 16 protecting upward through the apertures 36 to receive the keystems 28.

Preferably the membrane layers 32,34 are spaced by a spacer layer 38 that has enlarged apertures 40 surrounding the switch contact area that are larger in diameter or cross-dimension than the apertures 36 thereby defining the switch contact area in which a portion of the upper membrane layer is unsupported by the spacer layer 38. Alternative the spacer layer 38 may be replaced by a dielectric pattern printed on either the lower side of the upper layer 34, or the upper side of the lower layer 32, spaced from the switch contact areas, as illustrated in the previously mentioned U.S. Pat. No. 4,382,165.

Each membrane keyswitch 30 has a first electrical switch contact element 42 on the upper side of the lower layer 32. Preferably the first electrical switch contact element 42 is formed of an electrically conductive ink circuit path or trace printed on the upper side of the lower layer 32 within the switch contact area. The first switch contact element 42 is preferably a part of an electrical circuit and may be connected by a lead such as a lead trace to keyswitch sensing circuits. Preferably the first switch contact element 42 is formed in an elongated curved trace about the keystem receiving element 16. The element 42 may extend in a full or partial arc or circle about element 16. Preferably the element 42 is concentric with the element 16.

Each membrane keyswitch 30 has a second electrical switch contact element 46 on the lower side of the upper layer 34 immediately above and aligned with the first switch contact element 42. Preferably the second electrical switch contact element 46 is formed of an electrically conductive ink circuit path or trace printed on the lower side of the upper layer 34. Preferably the second switch contact element 46 is formed in an elongated curved trace about the corresponding keystem receiving element 16. The element 46 may extend in a full or partial arc or circle about element 16. Preferably the element 46 is concentric with the element 16 and with the first switch contact element 42.

Preferably the first and second electrical switch contact elements 42 and 46 have thickness of approximately 0.0012 to 0.0016.

Each membrane keyswitch 30 has switch contact dielectric pads or discrete traces 50 placed over angularly spaced segments of one of the switch contact elements 42,46 to cover over such segments and provide raised insulative mounds or ridges between uncovered or exposed conductive adjacent segments 52. Each pad 50 has a thickness sufficient to prevent the switch contact elements 42 and 46 in the switch contact area from contacting each other when the keytop 26 is not depressed. Preferably each pad 50 has a thickness of approximately 0.0012 and 0.0016 inches which provides for a contact gap of approximately 0.0012 and 0.0016 inches between the switch contact elements 42 and 46.

Figure 7:
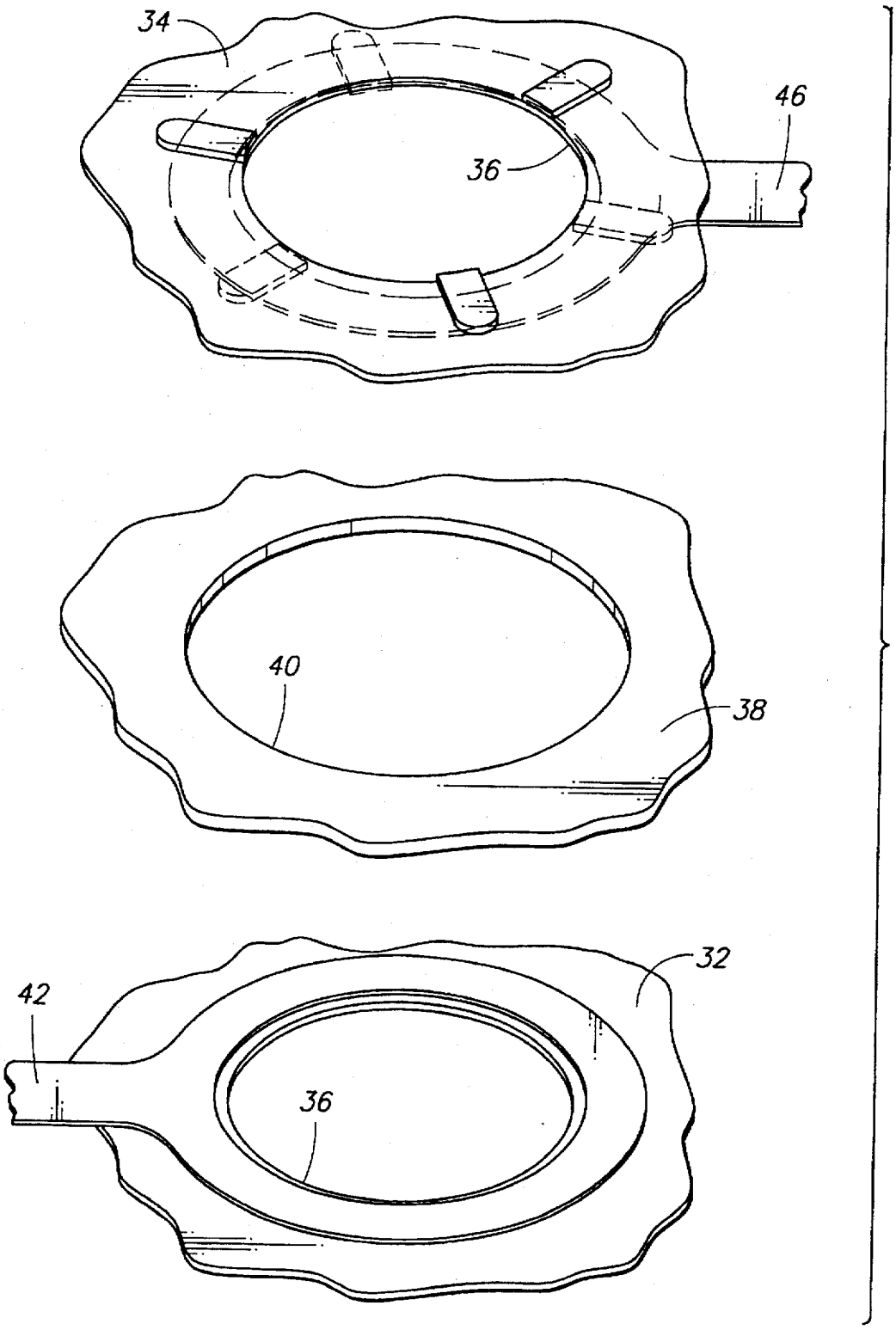
FIG. 7 is an exploded view of a membrane keyswitch of a preferred embodiment of the present invention.
Figure 8B:
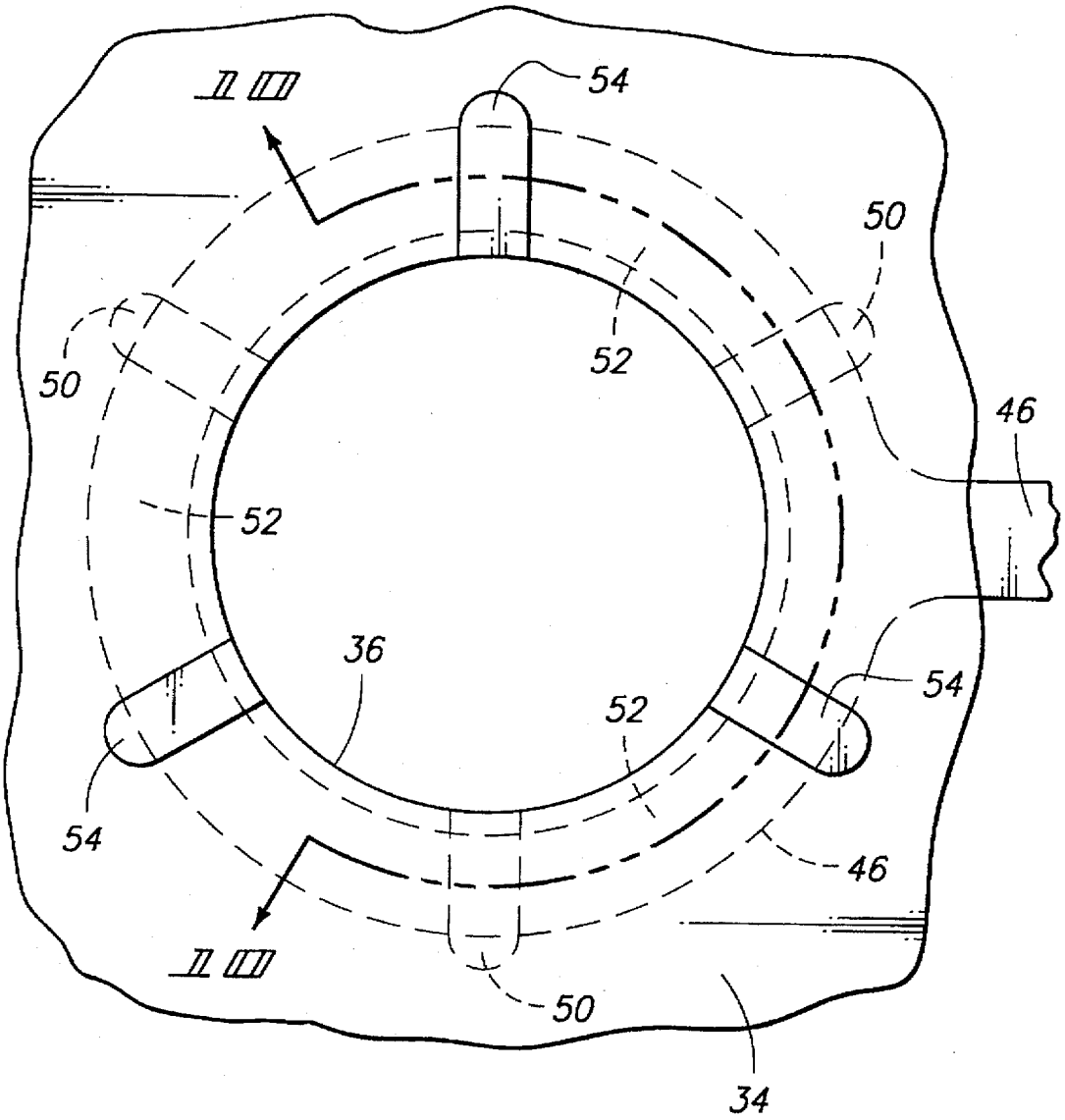
FIG. 8 is top view of a portion of the upper circuit layer of the membrane keyswitch shown in FIG. 7.
Figure 9:
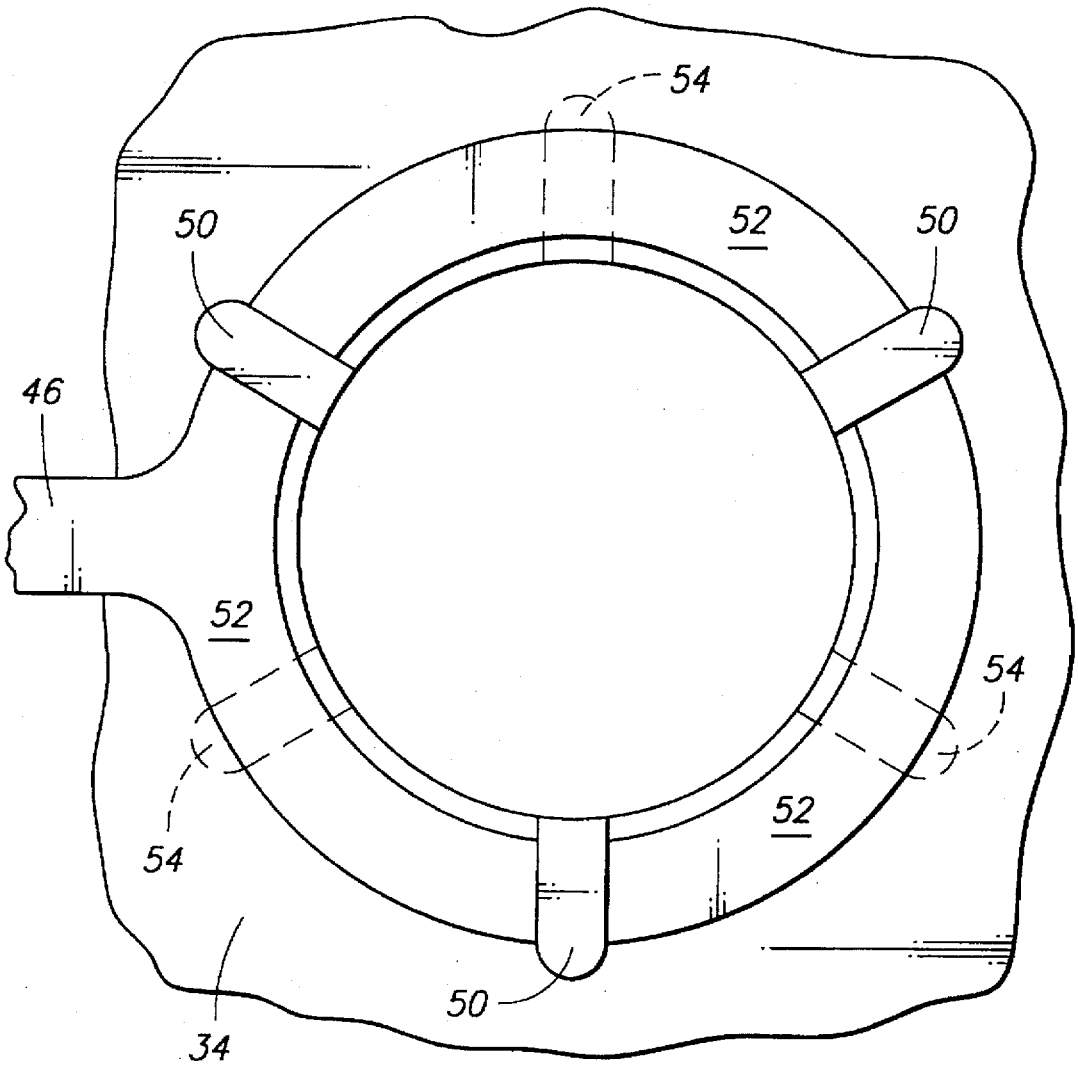
FIG. 9 is a bottom view of a portion of the upper circuit layer illustrated in FIG. 8.
Figure 11:
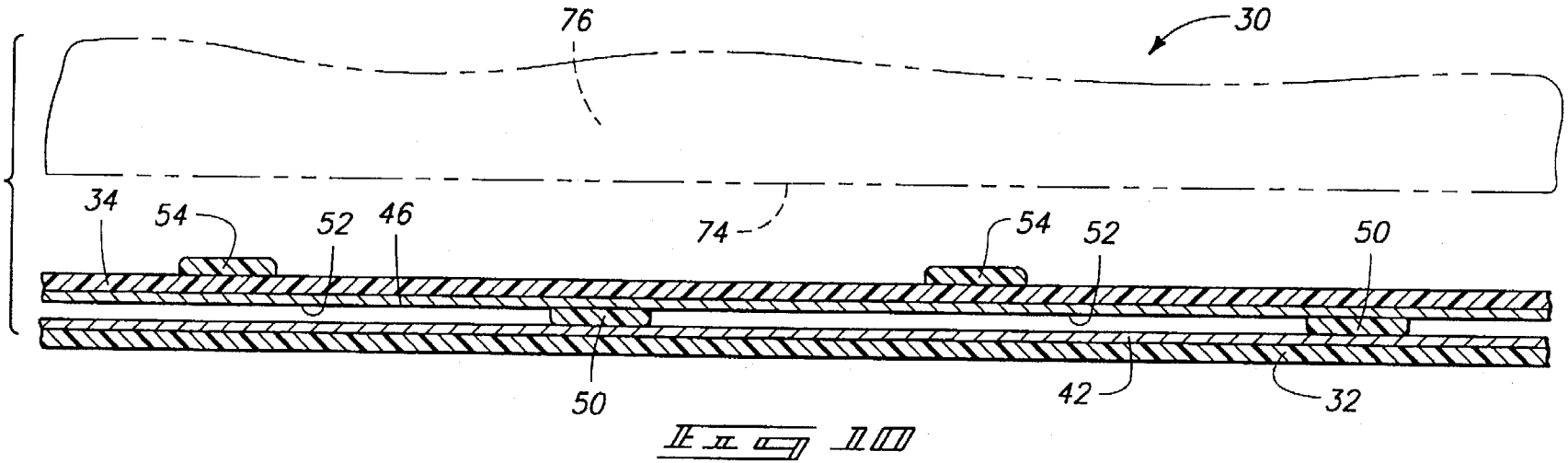
Figure 11:
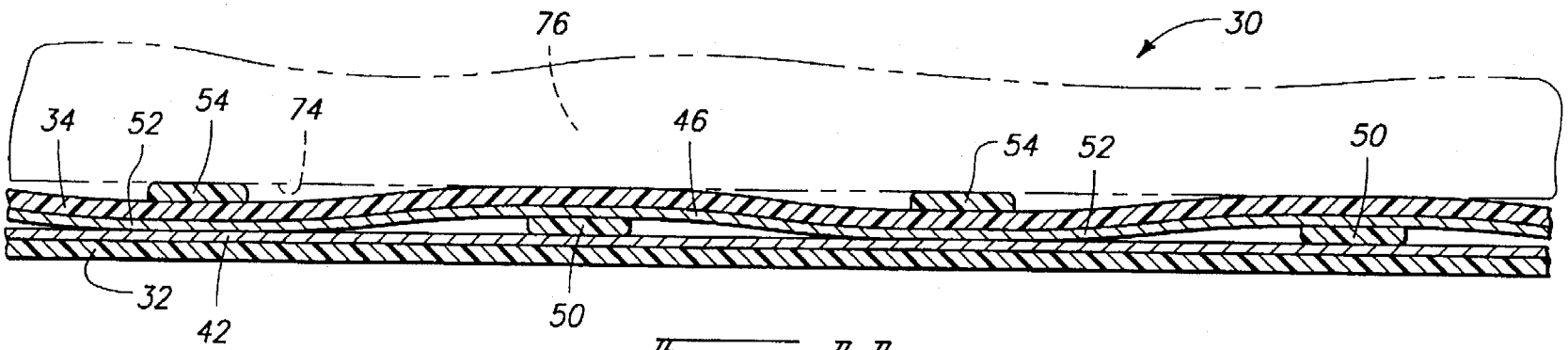

As illustrated in FIGS. 7–9, the switch contact dielectric pads 50 are preferably printed on the bottom side or underside of the upper layer 34 overlying or covering spaced segments of the second electrical keyswitch element 46 leaving intermediate segments 52 of the element 46 exposed or uncovered. Preferably the dielectric pads 50 are placed at evenly angularly spaced locations about the key axis.

In a preferred embodiment each keyswitch 30 has three dielectric pads 50 that are evenly spaced at approximately 120 degree intervals. Preferably each of the pads 50 is somewhat elongated and extends at a radial angle outward from the key axis covering a segment of the switch contact trace 46 while leaving exposed evenly spaced arcuate segments 52.

Each keyswitch 30 further includes multiple stress concentration pads 54 that are printed on the top side of the upper layer 34 within the switch contact area spaced intermediate the dielectric pads 50 and in actuation alignment with the exposed segments 52. When the keytop 26 is depressed an actuator engages the stress concentration pads 54 and deflects that portion of the upper layer 34 that is immediately thereunder to move the exposed segments 52 downward between two adjacent pads 50 into engagement with the first electrical keyswitch element 42 to "activate" the keyswitch.

Preferably each pad 54 is a discrete flexible printed trace having a thickness of approximately 0.0012 and 0.0016 inches, which provides for a membrane deflection stroke of approximately 0.0012 and 0.0016 inches.

As illustrated in FIGS. 7–9, the stress concentration pads 54 are preferably printed on the top side of the upper layer 34 overlying the exposed segments 52. Preferably the stress concentration pads 54 are printed at evenly angularly spaced locations about the key axis.

In a preferred embodiment (FIGS. 8 and 9) each keyswitch 30 has three stress concentration pads 54 that are evenly spaced at 120 degree intervals and are also angularly offset by 60 degrees from the pads 50 so that each pad 54 is located midway between two adjacent pads 50. Preferably each of the pads 54 is somewhat elongated and extends at a radial angle outward from the key axis overlying an exposed segment 52 of the switch contact trace 46 on the underside of the upper layer 34.

The widths or size of the pads 50 and/or pads 54 in the switch contact area may be varied to vary the keytop force required to activate the keyswitch 30. Such a feature provides a very inexpensive method for being able to readily change the depression force required to activate the keyswitches 30.

The computer keyboard 10 further includes a rubber dome sheet 60 (FIGS. 1–3) that is laid between the upper membrane layer 34 and the keytops 26 to bias the keytops 26 to their elevated undepressed position. The rubber dome sheet 60 has a rubber dome element 62 at each of the keyswitch positions that serves as a return spring and further protects the membrane switch from contamination. Each rubber dome element 62 has a central aperture 64 coaxial with the key axis that receives the upstanding keystem receiving element 16 to enable the element 16 to project upward into the aperture 64 to receive the keystem 28.

Each rubber dome element 62 has a lower enlarged base 66 that sits on the upper membrane layer 34 coaxial with the key axis and radially placed outward with respect to switch contact area. A somewhat truncated buckling conical body 68 extends upward from the base 66 to a cylindrical open upper end 70. The intermediate body 68 is designed to buckle as the keytop is depressed to tactile break away feature.

Figure 11:
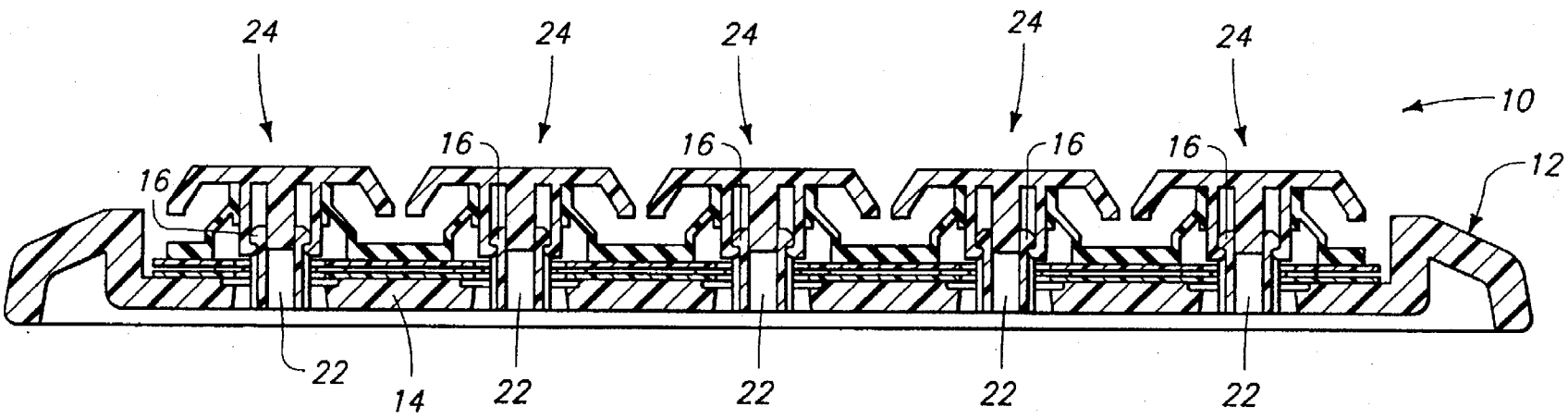
FIG. 11 is a vertical cross-sectional view similar to FIG. 10 except showing the membrane keyswitch in the activated condition.

The cylindrical end 70 has a cylindrical appendage 72 in the form of cylindrical wall that serves as the membrane switch actuator. The cylindrical wall has a lower edge 74 that engages the stress concentration pads 54 when the keytop 26 is depressed to activated the keyswitch. As the rubber dome is buckling, the lower edge 74 engages the pads 54, as illustrated in FIG. 11, to deflect the exposed segments 52 of the second electrical keyswitch element 46 downward into engagement with the first electrical keyswitch element 42.

When the keytop is released the rubber dome element 62 returns to its natural orientation and moves the keytop to its up position. The resiliency of the flexible upper meeleane layer cause the second electrical contact element to withdraw from engagement with the first contact element 42.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A low-profile, full-travel computer keyboard comprising:

a key support member having an array of upstanding keystem receiving elements at key locations, in which each of the upstanding keystem receiving elements has an upright wall with a central bore defining an upright key axis;

a plurality of keys supported by the key support members at the key locations, in which each of the plurality of keys has a keystem with a central plunger that is slidably supported in a central bore of one of the upstanding keystem receiving elements to enable each of the plurality of keys to move in a full-travel stroke along the upright key axis between a low-profile rest position and a keyswitch actuation position;

a plurality of rubber dome return springs mounted on the key support member and engaging the plurality of keys for biasing the plurality of keys to their low-profile rest position;

a keyswitch membrane mounted on the key support member with the plurality of key support members extending up through corresponding plurality of membrane apertures formed in the keyswitch membrane at the key locations, with each of the plurality of membrane apertures aligned with a corresponding one of the key axes;

said keyswitch membrane having a plurality of membrane keyswitches, with each of the plurality of membrane keyswitches being associated with one of the key locations circumscribing at least in part one of the plurality of upright keystem support walls;

each of the plurality of membrane keyswitches having (1) a lower membrane layer with a first arcuate electrical circuit trace printed on a top surface thereof at one of the key locations, and (2) an upper membrane layer spaced from the lower membrane layer with a second arcuate electrical circuit trace printed on a bottom surface in contact alignment with the first arcuate electrical circuit trace at said one of the key locations;

each of the plurality of membrane keyswitches having a plurality of elongated, radially oriented, angularly spaced dielectric pads covering spaced non-contact segments of one of said arcuate electrical circuit traces opposing uncovered intermediate contact segments;

wherein each of said dielectric pads has a thickness sufficient to maintain the upper membrane layer spaced from the lower membrane layer to prevent the second electrical circuit trace from contacting the first electrical circuit trace when the key is in the rest position;

each of the plurality of membrane keyswitches having a plurality of elongated, radially oriented, angularly spaced stress concentration pads printed on a top surface of the upper layer angularly spaced intermediate the dielectric pads and in alignment with the uncovered intermediate contact segments of said one electrical circuit trace; and a keyswitch actuator at each of the key locations that is responsive to the movement of one of the keys from the rest position to the actuation position for engaging the stress concentration pads to deflect the uncovered segments of the upper membrane layer downward into contact engagement with the first electrical circuit trace of the lower membrane layer to activate the keyswitch.

2. The low-profile, full-travel computer keyboard as defined in claim 1 wherein the spaced dielectric pads are affixed to the bottom surface of the upper membrane layer.

3. The low-profile, full-travel computer keyboard as defined in claim 1 wherein the spaced dielectric pads are evenly angularly spaced covering evenly spaced non-contact segments of one of said arcuate electrical circuit traces exposing evenly spaced uncovered intermediate contact segments.

4. The low-profile, full-travel computer keyboard as defined in claim 1 wherein the plurality of rubber dome return springs are formed integrally with a rubber dome sheet that overlies the keyswitch membrane with each of the plurality of dome return springs aligned with a corresponding one of the key axes.

5. The low-profile, full-travel computer keyboard as defined in claim 4 wherein each of the keyswitch actuators comprises an appendage on the rubber dome for engaging the stress concentration pads to deflect the upper membrane layer into contact with the lower membrane layer to activate the keyswitch.

* * * * *